US010538947B2

(12) United States Patent
Boring et al.

(10) Patent No.: US 10,538,947 B2
(45) Date of Patent: Jan. 21, 2020

(54) SLIDING BARN DOOR HARDWARE

(71) Applicant: JELD-WEN, Inc., Klamath Falls, OR (US)

(72) Inventors: Tommy Boring, Maryville, TN (US); Stephen Sisson, Caledonia, MI (US); James Cooper, Klamath Falls, OR (US); Joe Miranda, Klamath Falls, OR (US); Brian Powell, Klamath Falls, OR (US)

(73) Assignee: JELD-WEN, Inc., Charlotte, NC (US)

( * ) Notice: Subject to any disclaimer, the term of this patent is extended or adjusted under 35 U.S.C. 154(b) by 39 days.

(21) Appl. No.: 15/452,586

(22) Filed: Mar. 7, 2017

(65) Prior Publication Data

US 2017/0298669 A1 Oct. 19, 2017

Related U.S. Application Data

(60) Provisional application No. 62/304,885, filed on Mar. 7, 2016.

(51) Int. Cl.
*E05D 15/06* (2006.01)

(52) U.S. Cl.
CPC ..... *E05D 15/063* (2013.01); *E05D 15/0626* (2013.01); *E05D 15/0652* (2013.01); *E05D 15/0656* (2013.01); *E05D 15/0665* (2013.01); *E05Y 2900/132* (2013.01)

(58) Field of Classification Search
USPC ..... 49/410–412
See application file for complete search history.

(56) References Cited

U.S. PATENT DOCUMENTS

| | | | | |
|---|---|---|---|---|
| 2,574,496 A | | 11/1951 | Pomeroy et al. | |
| 2,867,859 A | * | 1/1959 | Brink | E06B 3/4636 16/93 R |
| 2,950,756 A | * | 8/1960 | Moloney | E05D 15/0669 16/105 |
| 3,052,930 A | * | 9/1962 | Mathews | A47K 3/34 16/93 R |
| 3,384,998 A | * | 5/1968 | Abramson | A47K 3/34 16/90 |
| 3,460,290 A | * | 8/1969 | Wutzke | E05D 15/063 49/411 |
| 3,562,956 A | | 2/1971 | Johnson, Jr. | |
| 3,829,930 A | | 8/1974 | McNinch | |
| 4,104,829 A | | 8/1978 | Agcaoili | |

(Continued)

FOREIGN PATENT DOCUMENTS

| | | | |
|---|---|---|---|
| EP | 1400647 | A1 | 3/2004 |
| WO | WO 2014/174512 | A1 | 10/2014 |

OTHER PUBLICATIONS

KROWNLAB Bottom Guide Channel, archived at https://krownlab.com/media.uploads/blog/Bottom_Guide_Channel_2012.jpg, accessed on Apr. 10, 2017.

*Primary Examiner* — Marcus Menezes
(74) *Attorney, Agent, or Firm* — Stoel Rives LLP

(57) ABSTRACT

The present disclosure provides for a sliding (barn-style) door and methods and hardware for mounting. The sliding barn door includes a door slab and mounting hardware including a top extension and a bottom extension. The top and bottom extensions each have a rectangular face having substantially the same dimensions and configured to lengthen the height of the door slab.

22 Claims, 4 Drawing Sheets

(56) References Cited

U.S. PATENT DOCUMENTS

| | | | | |
|---|---|---|---|---|
| 4,112,622 | A * | 9/1978 | Stewart | E05D 15/066 16/91 |
| 4,809,000 | A * | 2/1989 | Carroll | E06B 1/34 342/61 |
| 5,839,228 | A * | 11/1998 | Duffy | A47K 3/34 49/223 |
| 6,336,247 | B1 * | 1/2002 | Schnoor | E05D 15/0634 16/105 |
| 7,644,542 | B2 * | 1/2010 | Ambrozus | E05D 15/0669 49/411 |
| 8,056,286 | B2 * | 11/2011 | Gosling | E05D 15/063 49/404 |
| 8,182,052 | B2 * | 5/2012 | Bourgain | E05B 47/026 312/139.2 |
| 8,375,638 | B2 * | 2/2013 | Martin | E04B 2/827 49/409 |
| 9,091,106 | B2 | 7/2015 | Allen et al. | |
| 2003/0201074 | A1 * | 10/2003 | Schnoor | E06B 3/4636 160/90 |
| 2006/0201066 | A1 * | 9/2006 | Lai | E05D 15/0656 49/410 |
| 2012/0117881 | A1 * | 5/2012 | Seymour | E05F 17/004 49/130 |
| 2014/0311035 | A1 | 10/2014 | Gilliam | |
| 2015/0240552 | A1 * | 8/2015 | Kim | E05D 15/0665 49/411 |

* cited by examiner

SLIDING BARN DOOR HARDWARE

RELATED APPLICATION DATA

This application is a non-provisional of and claims the benefit under 35 U.S.C. § 119(e) of U.S. Provisional Patent Application No. 62/304,885, filed Mar. 7, 2016, the disclosure of which is incorporated by reference herein in its entirety.

TECHNICAL FIELD

The field of this disclosure relates to door mounting systems and, more particularly, to such systems for mounting sliding doors on a wall adjacent to the door opening.

BACKGROUND

Door hanging systems include hinged doors and sliding doors. Hinged doors are hung from the side; they open and close by pivoting radially on the hinges. The door slab of a hinged door is sized to the door opening and fits in the door opening so snugly that, when closed, there is minimal clearance left between the perimeter of the door slab and the perimeter of the door opening. Sliding doors, by contrast, are supported from the top or the bottom of the door and slide linearly along a weight-bearing track or rail. A second track or rail, typically non-weight-bearing, may engage the other of the top or bottom of the door to prevent the door from swinging or tipping into the room or banging against the wall. Tracks for a sliding door may be installed within the door opening, for example, of a pocket-style door that receives the door slab into a pocket formed in the wall adjacent the door opening. Alternatively, in a barn-style sliding door, the top rail is installed outside the door opening, for example on a wall surface or trim surface above the door opening. The barn door opens by sliding along the wall, parallel to and outside the wall. In a barn-style door, the door slab is made larger than the door opening so that, when closed, the door slab of a barn-style door overlaps the wall by a few inches. Overlap is preferred for obscuring the door opening from sound or light traveling through the opening and, in aftermarket installations, for obscuring door frame trim leftover from a hinged door.

SUMMARY

Sliding barn doors are appealing for a variety of reasons. Barn doors do not sweep as far into the room when opening as a hinged door. Barn doors are also preferable to pocket doors in that they do not require construction of a pocket within the wall. One downside to barn doors is that a renovator typically cannot reuse the door slab of a previous hinged door when upgrading to a barn door because the hinged door slab is too small; thus an entire new door must be purchased. The present inventors have recognized a need for a barn-style sliding door that can extend a door slab previously sized as a hinged door to a size suitable for use as a barn door and for a barn-style sliding door that is easy to install and attractive.

The present disclosure provides a sliding door for covering a door opening, comprising a door slab having a front face, a rear face opposite the front face, and spaced-apart top and bottom sides extending between the front and rear faces, the door slab having a slab height between the top and bottom sides and a width; a top extension member attached to the door slab adjacent the top side thereof, the top extension member having a first flange aligned with the front face of the door slab and extending along the width of the door slab, and an attachment member connected to the first flange and extending transversely therefrom, the attachment member being secured to the top of the door slab; and a bottom extension member attached to the door slab adjacent the bottom side thereof, the bottom extension member aligned with the front face of the door slab and extending along its width, the top and bottom extension members protruding beyond the respective top and bottom sides of the door slab to result in a door height of the door that is greater than the slab height.

The present disclosure further provides a method for installing a sliding barn door, comprising providing a rectangular door slab having a front face, a rear face opposite the front face, and spaced-apart top and bottom sides extending between the front and rear faces, the door slab having a slab height between the top and bottom sides and a width; providing a top extension having a first flange and a first wall-side flange connected to and spaced apart from and substantially aligned with the first flange, the first flange having a width approximately equal to the width of the door slab; providing a bottom extension having a second flange having substantially the same dimensions as the first flange; positioning the top extension at the top side of the door slab so that the first flange is aligned with the front face of the door slab to result in a door height of the door that is greater than the slab height; securing the top extension to the door slab; positioning the bottom extension at the bottom side of the door slab so that the second flange is aligned with the first flange and is adjacent to the front face of the door slab to further increase the door height of the door; and securing the bottom extension to the door slab.

Additional aspects and advantages will be apparent from the following detailed description of preferred embodiments, which proceeds with reference to the accompanying drawings.

DETAILED DESCRIPTION OF PREFERRED EMBODIMENTS

This section describes particular embodiments and their detailed construction and operation. The embodiments described herein are set forth by way of illustration only and not limitation. Throughout the specification, reference to "one embodiment," "an embodiment," or "some embodiments" are not necessarily referring to the same embodiment. The described features, structures, characteristics, and methods of operation may be practiced in isolation or combined in any suitable manner, and can be practiced without one or more of the specific details or with other methods, components, materials, or the like. In other instances, well-known structures, materials, or methods of operation are not shown or not described in detail to avoid obscuring more pertinent aspects of the embodiments.

Figure 1:
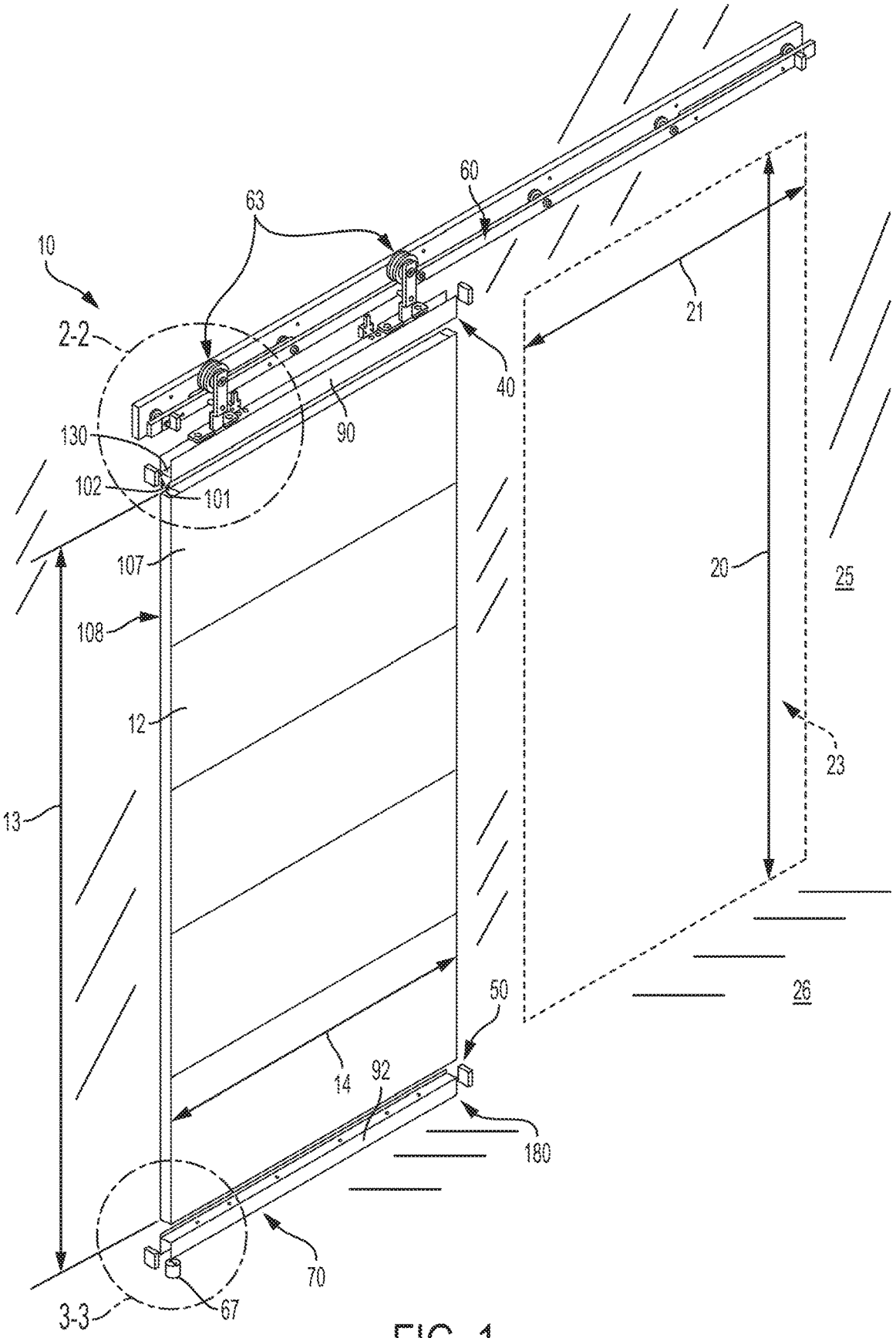
FIG. 1 shows an assembly view of one embodiment of a sliding door.

As shown in FIG. 1, a sliding door 10 includes a door slab 12 having a height 13 and a width 14 approximately equal to the height 20 and width 21 of a door opening 23 formed in wall 25 above floor 26. The door slab 12 may be sized as a hinged door or may have a height 13 greater than the height 20 of the door opening 23 or a width 14 greater than the width 21 of the door opening 23. The sliding door of this disclosure further includes one or more extensions 40, 50 to the door slab 12. Extensions 40, 50 extend the height of door 10 beyond height 20 of the door opening and cause door 10 to reach from approximately floor 26 to a top rail 60 mounted above the door. Top rail 60 supports and guides sliding door 10 along its slide path between an open position (shown) and a closed position. The term "top rail" is not limited to rails but may signify a track or post or other structure that guides or supports sliding door 10 along its slide path. Top extension 40 to door slab 12 includes one or more low friction contact members, preferably wheels 63, to connect door 10 to top rail 60. A bottom guide, such as a rail or post 67, is provided on or near floor 26 for guiding sliding door 10 along its slide path. Bottom extension 50 to door slab 12 includes one or more low friction contact members, preferably a track 70, to connect the door to bottom guide 67. To enhance the visual attractiveness of the extension system, the top extension and the bottom extension may include a first flange 90 and a second flange 92, sized approximately equally. When arranged in a preferred arrangement, first flange 90 and second flange 92 provide an upper horizontal band and a lower horizontal band extending across width 14 of the door slab 12 at the top and bottom of door 10, respectively. In the preferred arrangement, the upper horizontal band and a lower horizontal band share a visual attribute such as color that contrasts visually with a visual attribute such as color of the door slab 12 to provide a visual letterboxing effect.

Figure 2:
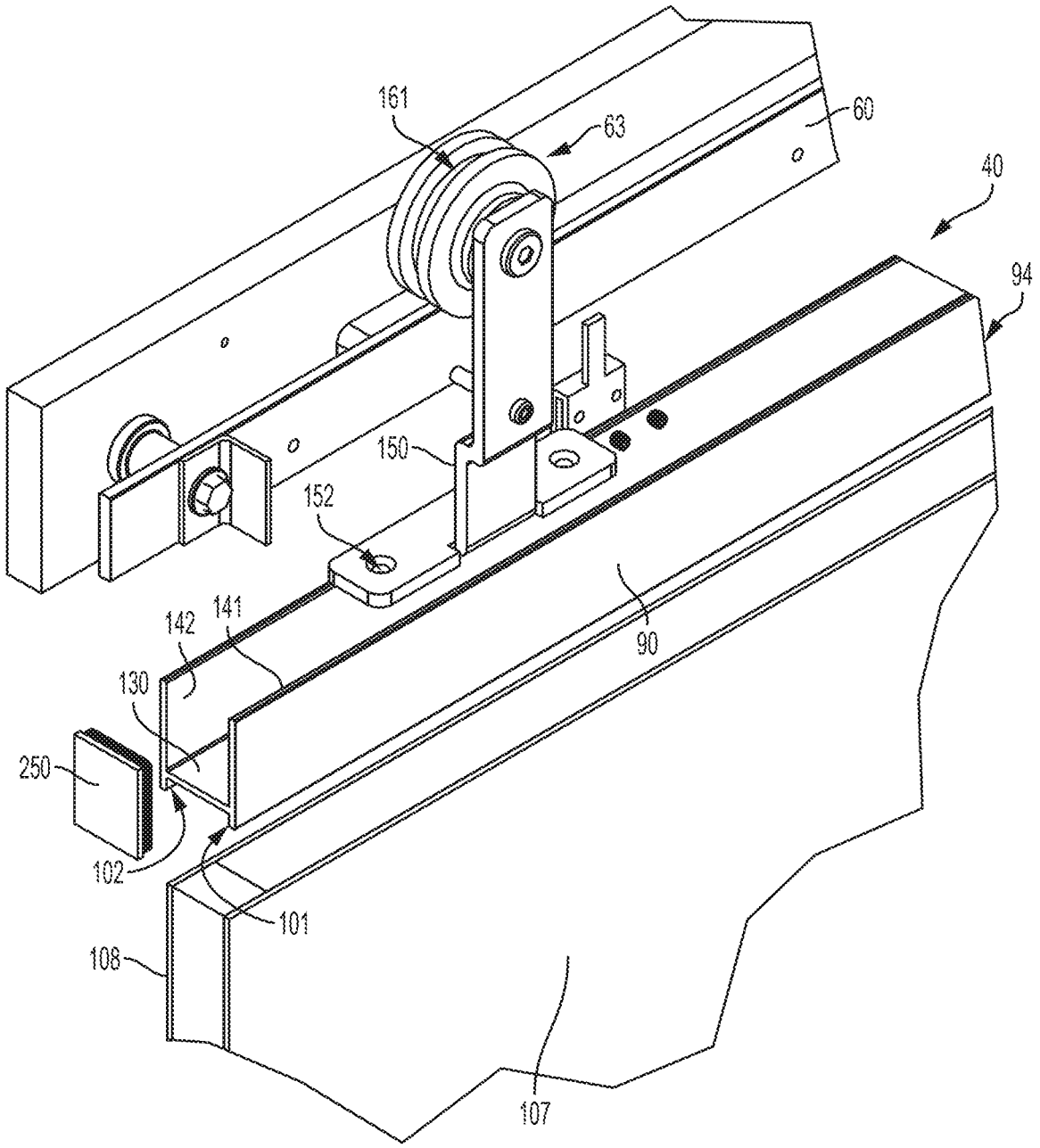
FIG. 2 shows an enlarged view of a portion of the door at detail 2-2 of FIG. 1.

With reference to FIG. 2, top extension 40 is secured to the top of the door slab 12. Top extension 40 includes a top bar 94 with an H-shaped cross-sectional profile. The H-shaped profile of the top extension includes lower flange portions 101, 102 that overlap front (display) face 107 and back (wall) face 108, respectively, of door slab 12 and aid in mounting top extension 40 securely. The top extension 40 includes an attachment member, preferably a web 130, which extends between and connects lower flange portions 101 and 102. When installing top extension 40, web 130 overlays the top side of door slab 12 and includes pre-formed holes (not shown, but see holes 224 in bottom extension 50 in FIG. 3) for receiving fasteners (not shown, but see fasteners 226, securing a bottom extension having modified extrusion profile 309 to the bottom side of a door slab in FIG. 6) or positioning fasteners on door slab 12 to secure top extension 40 to the top of door slab 12. In some embodiments, not shown, the attachment member of the top extension comprises one or more attachment tabs that extend transversely from the flange that overlaps the front (display) face 107 of door slab 12 and toward the back (wall) face 108 of door slab 12. Top extension 40 may be secured to the top of the door slab by being fastened to the back (wall) face 108 of door slab 12 or to the top side of door slab 12 or to the front (display) face 107 of door slab 12. In another embodiment, top extension 40 attaches to the top of the door slab on front (display) face 107 of door slab 12 with finish-quality screws or other fasteners, in which case the attachment member may be integral with first flange 90.

The H-shaped profile of the top extension also includes upper flange portions 141, 142 that extend upward, adding to the flexural rigidity of top extension 40 and providing structural support for including one or more hangers 150 that reach to top rail 60. Upper flange portion 141 and lower flange portion 101 together comprise first flange 90. A plurality of hangers 150 of the top extension carry low-friction contact members, preferably wheels 63, along top guide rail 60 installed above door opening 23. Hangers 150 may be integrally formed in top extension 40 or fixed to top bar 94 in the factory. Preferably, each hanger 150 includes holes 152 or pre-formed slots for the installer to attach hanger 150 to top bar 94. The top extension 40, including hangers, has a height that, when combined with bottom extension 50 and door slab 12, extends height 13 of door 10 beyond height 20 of door opening 23 to span approximately from floor 26 to top rail 60. Wheels 63 rest on top rail 60 to support the weight of door 10 and to enable a smooth translation of the door between open and closed positions. In some embodiments a groove 161 is formed in wheel 63 to engage top rail 60, or vice versa, to prevent wheels 63 from slipping off top rail 60. Pre-formed holes or slots are preferred in all pieces of mounting hardware that must be connected by the end user to enable the end user rapidly to assemble the mounting system in such a way that the weight-bearing point of contact (such as the point where wheel 63 contacts top rail 60) aligns vertically with the center of gravity of door 10 to enable door 10 to hang vertically rather than at an angle.

A person of skill in the art will appreciate that weight-bearing support members may be included in the bottom extension 50 without departing from the principles disclosed herein. Weight-bearing struts or hangers along with contact members may be attached to the bottom of the door, and the top extension 40 may include no hangers, or possibly non-weight-bearing or reduced-weight-bearing hangers, along with one or more contact members that engage the top rail or a guide post, to keep the door balanced vertically.

Figure 3:
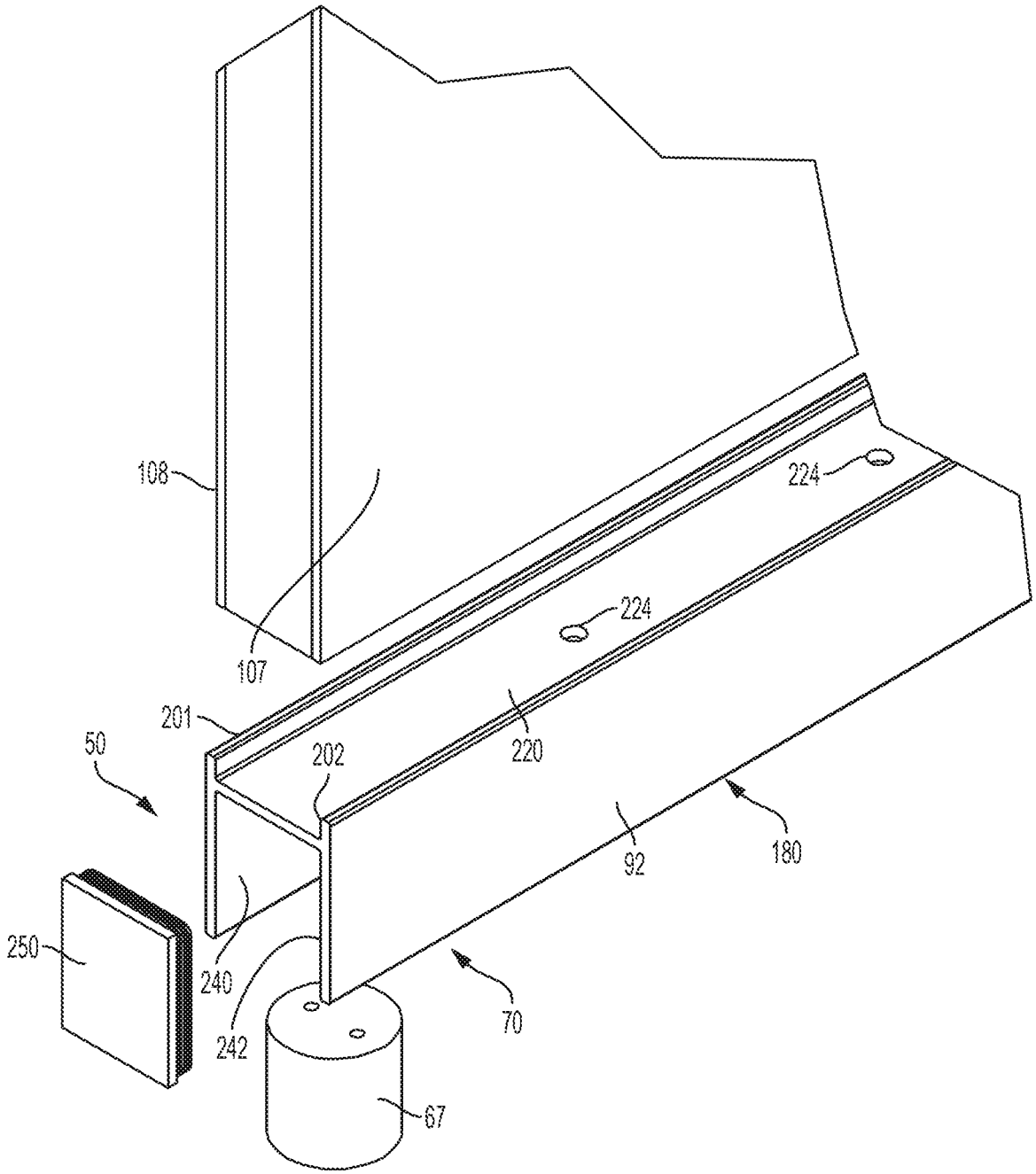
FIG. 3 shows an enlarged view of a portion of the door at detail 3-3 of FIG. 1.

With reference to FIG. 3, a bottom extension 50 is attached to the bottom of door slab 12. The bottom extension includes a bottom bar 180 having an H-shaped profile. The H-shaped profile of the bottom extension includes lower flange portions 201, 202 that overlap back face 108 and front face 107, respectively, of the door slab. Bottom extension 50 includes an attachment member such as web 220, or alternatively one or more attachment tabs. Preferably, when installing the bottom extension on the door slab, the attachment member overlays the bottom side of door slab 12 and includes pre-formed apertures or guides, such as holes 224 for receiving fasteners 226 (FIG. 6) or positioning fasteners on door slab 12 to secure the bottom extension 50 to door slab 12. In some embodiments, not shown, the attachment member of the bottom extension comprises one or more attachment tabs that extend transversely from the flange that overlaps the front (display) face 107 of door slab 12 and toward the back (wall) face 108 of door slab 12. Bottom extension 50 may be secured to the top of the bottom slab by being fastened to the back (wall) face 108 of door slab 12 or to the bottom side of door slab 12 or to the front (display) face 107 of door slab 12. In another embodiment, bottom extension 50 attaches to the bottom of door slab 12 on front (display) face 107 of the door slab using finish-quality screws or other fasteners, in which case the attachment member may be integral with second flange 92.

The H-shaped profile of the bottom extension 50 also includes upper flange portions 240, 242 that extend downward, adding to the flexural rigidity of the bottom extension and providing a contact member (track 70) that engages a floor guide 67. Contact member 70 is formed integrally with bottom bar 180, and the floor guide in this embodiment comprises a post 67 mounted on the floor 26. A skilled person will appreciate that the locations of the track and the post may be reversed so that the post is included in the bottom extension 50 of the door and the track is mounted on the floor 26 or, alternatively, on the wall near the floor, without departing from the principles of this disclosure. In such embodiments (not shown), the term "floor guide" is not limited to tracks, posts, or rails mounted on the floor but may signify a track or a post or other guide mounted on the wall near the floor. In one embodiment, not shown, the bottom extension further includes holes or pre-formed slots for attaching one or more struts or hangers to the bottom extension. Struts or hangers of the bottom extension 50 may include wheels, or other low-friction couplers, which contact a floor guide when the door is installed. Lower flange portion 202 and upper flange portion 242 together comprise the second flange 92.

In some embodiments of door 10, door slab 12, sized as a hinged door, is extended at least one inch beyond height 20 of door opening 23 by attaching top extension 40 or bottom extension 50 or both in combination. In other embodiments, the height of the sliding door is extended by at least two inches, and in other, by at least three inches beyond the height 20 of the door opening 23. In such embodiments, the height of sliding door 10 may be measured from the bottom of door 10, at a point nearest the floor, to a contact member of the top extension (where the contact member is designed to contact the top rail or guide post) rather than from the bottom of bottom bar 180 to the top of top bar 94. In yet other embodiments, a kit for converting a hinged door into a sliding barn door includes a top extension and a bottom extension having a combined height that extends the height of the door slab of a hinged door by at least one inch, or by at least two inches, or by at least approximately three inches. In another embodiment, not shown, the door slab 12 is extended using only one of a top extension or a bottom extension.

The embodiment shown further includes an end cap 250 on one or more ends of bottom extension 50 or top extension 40. This improves the aesthetic appeal of the extension. End cap 250 may also serve as a stop, for instance on the bottom extension when it contacts the floor guide, such as post 67, to prevent the door from progressing further in one direction along the slide track. Other preferred embodiments, not shown, include a soft close mechanism to prevent the door from stopping its slide abruptly or banging against an end of its slide path. The end of the slide path may be determined at the top extension, the top rail, the bottom extension, or the floor guide. The soft close mechanism may be installed on any one of those or another suitable location, and a corresponding soft-close activator may be installed in any appropriate place to activate the soft close mechanism at the end of the sliding door's slide path.

Figure 7:
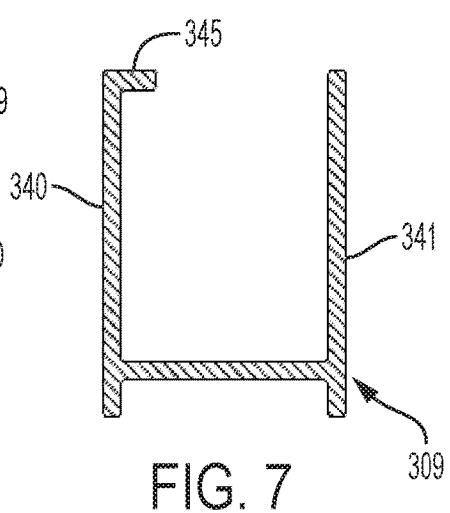
FIG. 7 shows a substantially H-shaped cross-section of an extension bar extrusion of the door of FIG. 4.
Figure 6:
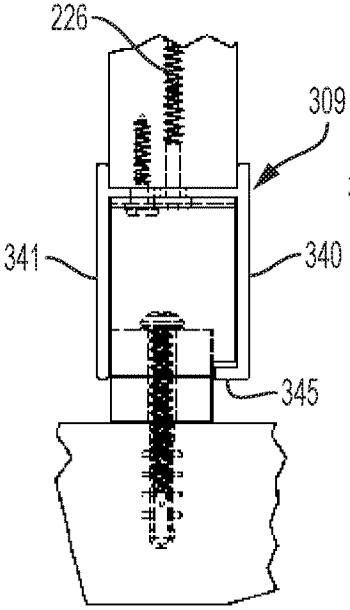
FIG. 6 shows a left-side profile view of the bottom extension hardware of the door of FIG. 4.
Figure 5:
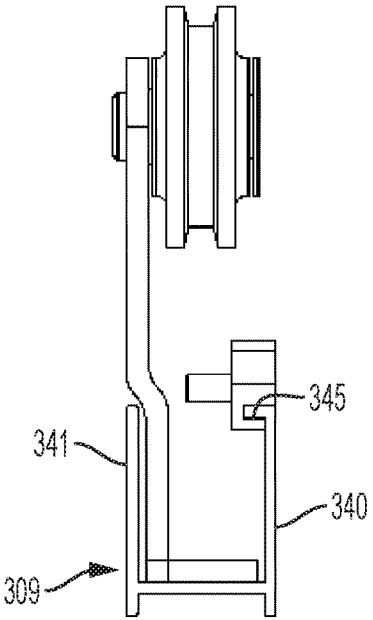
FIG. 5 shows a right-side profile view of the top extension hardware of the door of FIG. 4.
Figure 4:
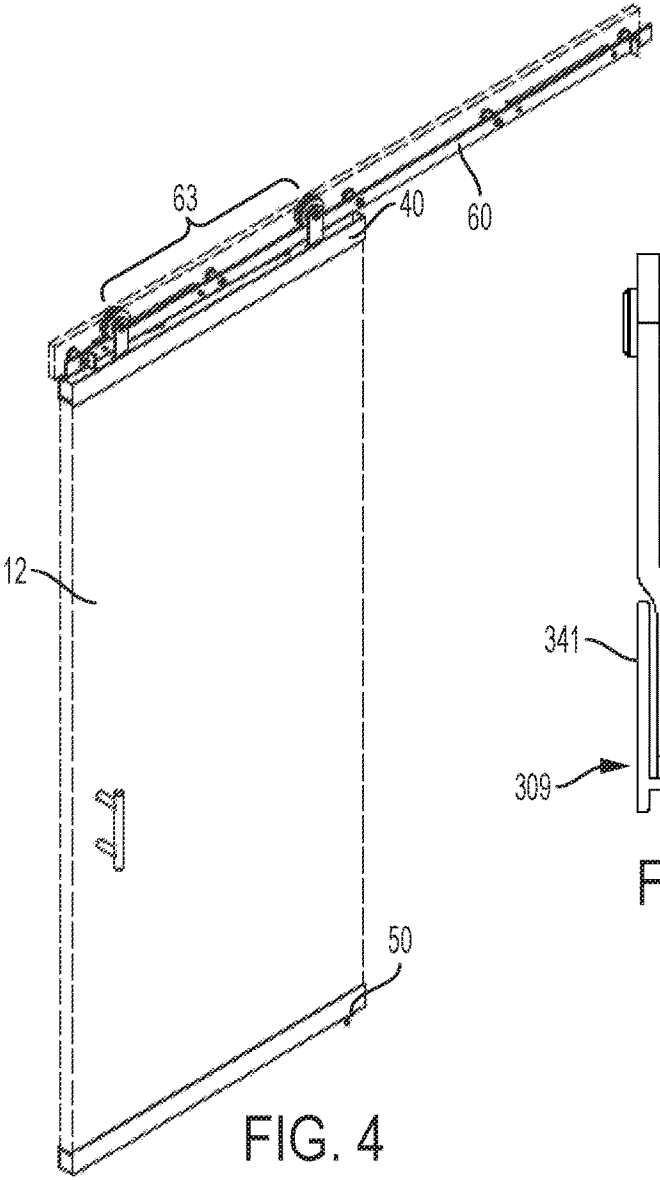
FIG. 4 shows an assembly view of another embodiment of a sliding door.

The embodiment of FIGS. 4-7 provides a modified extrusion profile 309 for the top extension and the bottom extension. Referring to FIGS. 5-7, the extrusion profile remains substantially H-shaped, having a web separating primary flanges 340 and 341, but further includes angle 345 extending inwardly, toward the center of the H, from the end of flange 340. In some embodiments, not shown, angle 345 may comprise a ridge that extend obliquely from the end of flange 340, a rounded surface that extends from the end of flange 340 and ends at an intermediate position along flange 340, or a ridge or rounded surface that extends outwardly, away from the center of the H, from the end of flange 340. Angle 345 may provide additional flexural rigidity to extrusion profile 309, may provide attachment surfaces for additional door components such as a soft close mechanism, may improve the finished appearance of the end of flange 340 from which angle 345 extends, or may provide other structural or aesthetic benefits without departing from a substantially H-shaped extrusion profile.

It will be obvious to those having skill in the art that many changes may be made to the details of the above-described embodiments without departing from the underlying principles of the invention. The scope of the present invention should, therefore, be determined only by the claims.

The invention claimed is:

1. A sliding door, comprising:

a door slab having a front face, a rear face opposite the front face, and spaced-apart top and bottom sides extending between the front and rear faces along respective top and bottom portions of the door slab, the door slab having a slab height between the top and bottom sides and a width;

a top extension member attached to the door slab adjacent the top side thereof, the top extension member having a first flange aligned with the front face of the door slab, the first flange extending along the width of the door slab and having a rectangular shape and a width that approximately equals the width of the door slab, and an attachment member connected to the first flange and extending transversely therefrom, the attachment member being secured to the top portion of the door slab; and a bottom extension member attached to the door slab adjacent the bottom side thereof, the bottom extension member aligned with the front face of the door slab and extending along the width of the door slab, the top and bottom extension members protruding beyond the respective top and bottom sides of the door slab to result in a door height of the door that is greater than the slab height; and a plurality of hangers, each hanger secured to the door slab behind the first flange and extending upwardly away from the top side of the door slab toward a distal end of the hanger which carries a wheel, the hangers and wheels configured and positioned to suspend the door slab from a rail such that the door slab hangs from the rail in a vertical orientation and to guide the door slab for movement along the rail between an open position and a closed position.

2. The sliding door of claim 1 wherein the top extension member has a first opposing flange spaced apart from and substantially aligned with the first flange and wherein the attachment member extends between and connects the first flange to the first opposing flange to form a substantially H-shaped profile.

3. The sliding door of claim 2 wherein the attachment member comprises a web that overlays the top side of the door slab.

4. The sliding door of claim 1 wherein the bottom extension member further comprises a second flange aligned with the front face of the door slab and extending along the width of the door slab.

5. The sliding door of claim 4 wherein the first flange and the second flange each have a height greater than one inch.

6. The sliding door of claim 4 wherein the first flange and the second flange each have a height greater than 2 inches.

7. The sliding door of claim 4 wherein the bottom extension member has a second opposing flange spaced apart from and substantially aligned with the second flange and wherein a bottom attachment member extends between and connects the second flange to the second opposing flange to form a substantially H-shaped profile.

8. The sliding door of claim 1 wherein the first and second flanges are made of metal.

9. The sliding door of claim 1, wherein the first and second flanges are rectangular, have substantially the same dimensions, and contrast visually with the front face of the door slab, so as to present a letterbox appearance.

10. The sliding door of claim 1 wherein the top extension member comprises a set of holes pre-formed in the top extension member to locate at least one fastening point for securing the top extension member to the door slab.

11. The sliding door of claim 1 further comprising fasteners securing the attachment member to the top side of the door slab.

12. The sliding door of claim 1 wherein at least one of the first and second flanges overlaps the front face of the door slab.

13. The sliding door of claim 1 wherein the attachment member connects to the first flange below a midpoint of the first flange.

14. The sliding door of claim 1 the top side of the door slab extends between first and second lateral sides of the door slab, the first and second lateral sides lying in respective first and second planes that are substantially perpendicular to the front face of the door slab, and wherein no portion of the first flange extends beyond the first lateral plane or the second lateral plane.

15. The sliding door of claim 1 wherein each hanger of the plurality of hangers is secured to the door slab by a fastener that engages the top portion of the door slab.

16. A method for installing a sliding door, comprising:

providing a door slab having a front face, a rear face opposite the front face, a top side extending between the front and rear faces at a top of the door slab, a bottom side spaced apart from the top side and extending between the front and rear faces at a bottom of the door slab, the door slab having a slab height between the top and bottom sides and a width;

providing a top extension member including a first flange, the first flange having a rectangular shape and a width that extends along the width of the door slab and is approximately equal to the width of the door slab, and a top attachment member connected to the first flange and extending transversely therefrom;

providing a bottom extension member including a second flange having a width approximately equal to the width of the door slab and a bottom attachment member connected to the second flange and extending transversely therefrom;

positioning the top extension member at the top of the door slab so that the first flange is aligned with the front face of the door slab to result in a door height of the door that is greater than the slab height;

securing the top attachment member to the door slab;

positioning the bottom extension member at the bottom of the door slab so that the second flange is aligned with the first flange and is adjacent to the front face of the door slab to further increase the door height of the door;

securing the bottom extension member to the door slab;

providing a plurality of hangers each carrying a wheel at a distal end of the hanger;

securing the hangers to the door slab behind the first flange so that the hangers extend with their distal ends upwardly away from the top side of the door slab; and suspending the door slab from a rail such that the door slab hangs from the wheels with the rail in a vertical orientation and the wheels guide the door slab for movement along the rail between an open position and a closed position.

17. The method of claim 16 wherein the top extension member further includes a first opposing flange spaced apart from the first flange, and the top attachment member extends between and connects the first flange to the first opposing flange to form a substantially H-shaped profile, the top attachment member comprising a web that overlays the top side of the door slab.

18. The method of claim 16 wherein at least one of the first flange and the second flange overlaps the front face of the door slab.

19. The method of claim 16 wherein the first flange and the second flange each have a height greater than 1 inch.

20. The method of claim 16 wherein the first flange and the second flange each have a height greater than 2 inches.

21. The method of claim 16 wherein the first and second flanges are rectangular and contrast visually with the front face of the door slab, so as to present a letterbox appearance.

22. The method of claim 16 wherein positioning the top extension member at the top of the door slab further comprises using a set of holes pre-formed in the top extension member to locate at least one fastening point for securing the top extension member to the door slab.

* * * * *